US011319138B2

(12) United States Patent
Veiseh

(10) Patent No.: US 11,319,138 B2
(45) Date of Patent: May 3, 2022

(54) POP-UP LINER

(71) Applicant: SIMPLE CONTAINER SOLUTIONS, INC., Rancho Dominguez, CA (US)

(72) Inventor: Charles S. Veiseh, Los Angeles, CA (US)

(73) Assignee: SIMPLE CONTAINER SOLUTIONS, INC., Rancho Dominguez, CA (US)

( * ) Notice: Subject to any disclaimer, the term of this patent is extended or adjusted under 35 U.S.C. 154(b) by 106 days.

(21) Appl. No.: 16/687,788

(22) Filed: Nov. 19, 2019

(65) Prior Publication Data

US 2020/0156852 A1 May 21, 2020

Related U.S. Application Data

(60) Provisional application No. 62/769,676, filed on Nov. 20, 2018.

(51) Int. Cl.
*B65D 81/38* (2006.01)
*B31D 5/00* (2017.01)

(52) U.S. Cl.
CPC ..... *B65D 81/3823* (2013.01); *B65D 81/3816* (2013.01); *B31D 5/00* (2013.01)

(58) Field of Classification Search
CPC ..... B65D 81/3823; B65D 81/3816; B65D 65/40; B65D 85/34; B31D 5/00
USPC ..... 229/103.11; 220/62, 592.26, 592.2, 220/62.22
See application file for complete search history.

(56) References Cited

U.S. PATENT DOCUMENTS 2,610,757 A * 9/1952 Irvine ..... B65D 81/3886 220/592.24
4,889,252 A * 12/1989 Rockom ..... B65D 81/3858 229/103.11
5,097,956 A * 3/1992 Davis ..... B32B 7/14 206/484
5,441,170 A * 8/1995 Bane, III ..... B65D 81/3862 229/103.11
5,478,867 A * 12/1995 Tabor ..... C08G 18/092 521/163
5,564,570 A * 10/1996 Jaszai ..... B65D 81/1075 206/213.1
5,638,979 A * 6/1997 Shea ..... B65D 77/02 206/521
5,889,067 A * 3/1999 Jang ..... C08J 9/146 521/117

(Continued)

*Primary Examiner* — Robert J Hicks
(74) *Attorney, Agent, or Firm* — Dilworth IP, LLC

(57) ABSTRACT

An insulating container liner comprising a first sectioned insulating panel piece comprising an insulating material and a thermoplastic shell enclosing the insulating material, wherein the first sectioned insulating paneling piece forms the bottom, a side and top of the insulating container liner; a second sectioned insulating panel piece comprising an insulating material, and a thermoplastic shell enclosing the insulating material, wherein the second sectioned insulating paneling piece forms the remaining three sides of the insulating container liner; and a flexible outer bag housing the first and second sectioned insulating panel pieces wherein the bag is attached to the first and second sectioned insulating panel pieces.

20 Claims, 10 Drawing Sheets

(56) References Cited

U.S. PATENT DOCUMENTS 6,599,850 B1 * 7/2003 Heifetz ..... E04B 9/0414 442/376
7,383,953 B2 * 6/2008 Dickinson ..... G09F 23/00 206/522
9,290,313 B2 3/2016 De Lesseux et al.
9,550,618 B1 * 1/2017 Jobe ..... B65D 5/64
9,650,198 B2 5/2017 De Lesseux et al.
9,950,830 B2 4/2018 De Lesseux et al.
9,957,098 B2 * 5/2018 Jobe ..... B65D 81/3848
9,980,609 B2 5/2018 De Lesseux et al.
9,981,797 B2 * 5/2018 Aksan ..... B65D 77/042
10,266,332 B2 * 4/2019 Aksan ..... B65D 81/3862
10,604,304 B2 * 3/2020 Waitermire ..... A45C 11/20
2001/0000461 A1 * 4/2001 Pfeiffer ..... B65D 75/38 383/86
2003/0175493 A1 * 9/2003 Naito ..... B29C 44/505 428/304.4
2004/0058119 A1 * 3/2004 Wynne ..... B32B 5/18 428/69
2005/0189404 A1 * 9/2005 Xiaohai ..... B65D 81/3862 229/103.11
2007/0032774 A1 * 2/2007 Glade ..... A61J 1/165 604/403
2007/0051782 A1 * 3/2007 Lantz ..... B65D 81/05 229/103.11
2007/0201770 A1 * 8/2007 Baner ..... B65D 33/105 383/6
2008/0260303 A1 * 10/2008 De Lesseux ..... A47J 41/0072 383/110
2008/0264925 A1 * 10/2008 Lockhart ..... A45C 7/0063 219/387
2010/0062921 A1 * 3/2010 Veiseh ..... B65D 5/509 493/186
2010/0252560 A1 * 10/2010 Churchill ..... B63B 35/00 220/560
2010/0314397 A1 * 12/2010 Williams ..... B65D 81/3823 220/592.01
2011/0299798 A1 * 12/2011 Coulson ..... B65D 31/04 383/103
2012/0207963 A1 * 8/2012 Jang ..... F16L 59/065 428/69
2012/0305433 A1 * 12/2012 Duner ..... B31B 70/00 206/496
2012/0305435 A1 * 12/2012 Matta ..... B65D 81/3862 206/521
2013/0306655 A1 * 11/2013 Takushima ..... B01D 53/0407 220/592.25
2013/0319970 A1 * 12/2013 Sugawara ..... B65D 77/003 215/373
2014/0205213 A1 * 7/2014 Beer ..... B65D 77/225 383/37
2014/0360044 A1 * 12/2014 Smith ..... F16L 59/065 34/468
2014/0367033 A1 * 12/2014 Smith ..... E04B 1/803 156/212
2016/0101916 A1 * 4/2016 Grijalva Varillas ..... B32B 5/22 383/102
2018/0079163 A1 * 3/2018 Mack ..... B32B 27/40
2018/0126661 A1 * 5/2018 Dunlap ..... B29C 66/7292
2018/0290815 A1 * 10/2018 Waitermire ..... B31B 70/26
2019/0185248 A1 * 6/2019 Aksan ..... B65D 81/3816
2020/0317423 A1 * 10/2020 Knight ..... B65D 81/382

* cited by examiner

POP-UP LINER

BACKGROUND

Industries that utilize insulated packaging have a need for high performance insulation for their shipping boxes that does not require a large amount of storage space and is easy to assemble when needed to line the interior of their shipping containers.

The current state of the art includes a multitude of options for insulated padded box liners including, but not limited to, rigid molded coolers, multi-piece panel box liners and bag type unitary box liners.

These options while effective, come with several drawbacks. Namely, lot quantities of rigid coolers such as those made of expanded polystyrene, while easy to use, require a very large amount of storage space since they are not collapsible.

Multiple piece, foldable, pad type box liners made of flexible insulation are collapsible and can be compressed for storage and transport, but require multiple step assembly within a carton because they are multi piece.

Bag type, one-piece liners are collapsible, can be compressed for shipping and transport and are easy to use, however, they come with certain drawbacks. Namely, liners such as those in U.S. Pat. Nos. 9,980,609, 9,950,830, 9,290,313, and 9,650,198 are manufactured using padding that is encased and un-attached to multiple layers of plastic film that encase it. This presents certain drawbacks since the encased interior padding section is unattached to the outer plastic film, and such padding also serves as the basis or internal framework of the finished assembled form of the liner, the user of the product must 'guess' about the proper orientation of the panels when installing the liner inside a box. This is especially difficult for liners designed for asymmetrically or rectangular length and width sized shipping boxes. Additionally, for the encased and un-attached pad to serve as a completely encasing liner for the bottom, four sides and a top lid of a shipping box, a specialized shape die-cut single panel pad must be provided since the interior pad would otherwise be impossible to manipulate into position. The current design of such an interior pad requires fashioning an hourglass shape of padding that in order to be installed inside a box requires the following steps: providing an opening of the flat packed article; manipulating the bottom of the article to create a flat bottom while joining the open bottom ends by aligning the edges; and then separating the four sidewalls that are abutted as it is inserted inside a container; loading of the article; and finally manipulating what is to be the top padding lid for proper installation at the top of container.

This method comes with many drawbacks, most of which are because the interior padding is encased and not visible. Since the padding is the only firm material in the article, the location of the panels as they relate to the proper panel they will line inside the box, is critical. The lack of visibility presents challenges in that the user of the article cannot be sure if the panels are properly positioned to completely line the inside of the box, and cannot be sure if the edges and joints at the bottom and top are misaligned after assembly. In addition, the user of such articles cannot easily manipulate what is not visible. This lack of surety is more likely if the box to be lined has an asymmetrical bottom panel dimension. The user of such an article cannot be sure how to properly position a liner since the only determinant of the bottom dimensions, and thus proper positioning of the liner, is padding that is both not visible since it is encased, and in a folded position until it is placed inside a container. The described assembly and generally any assembly can be tedious and time intensive. Additionally, since the prior art presents unitary insulation padding that is unsegmented and meant to be bent in order to fit certain interior angles of a shipping box, the packing volume efficiency of such a shipping box is not optimal since most foam materials tend to have an elastic tendency, and like to stay flat. This is especially apparent with the lid of the prior art systems which must be formed by bending an unsegmented portion of foam insulator in order to form a lid. In fact, the prior art relies upon a zip lock or other closure device applied to the outer bag to apply the full sealing of the article. This is inferior in that the outer film, with a typically inferior R value to the inner encased insulator, does not assure maximum performance when only that portion of the article provides a closed barrier to outside elements. Not only do the closure methods and positioning of the lid present challenges to the user, they can also greatly affect the performance of the assembled insulated container, since the edges of the panels may resist proper positioning.

There exists a need for an insulated padded liner that can be compressed for transport and storage, while providing visibility for proper orientation and easily installation inside a shipping container.

BRIEF DESCRIPTION OF THE DRAWINGS

The subject matter of the present disclosure will be more fully understood from the following detailed description, taken in connection with the accompanying drawings, in which.

SUMMARY OF THE INVENTION

Figure 1:
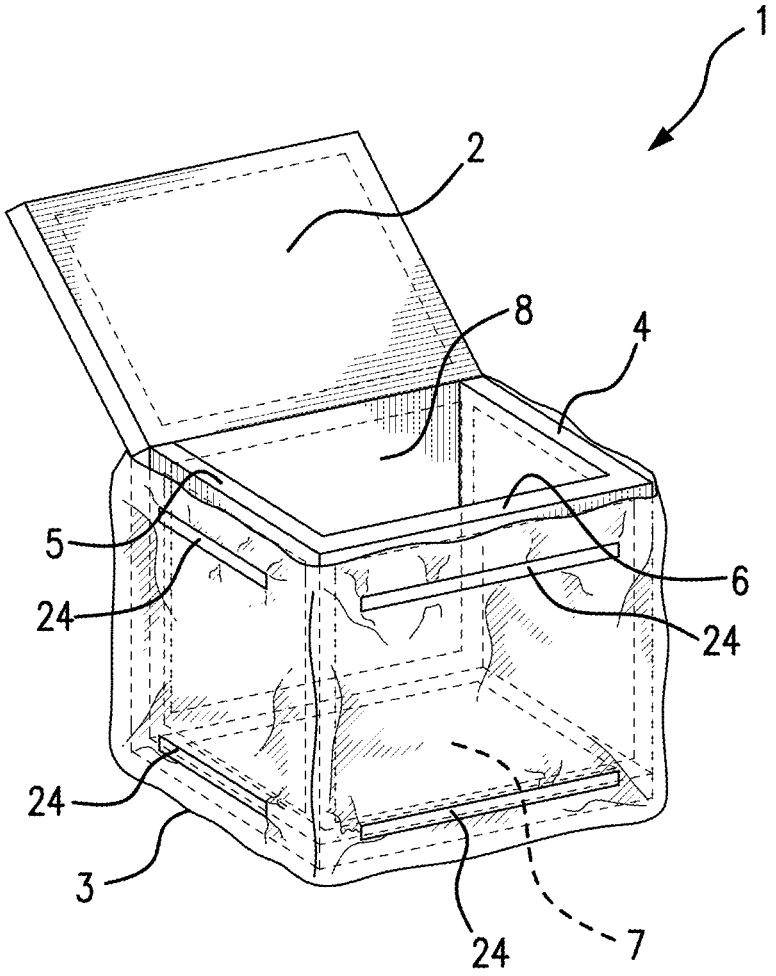
FIG. 1 shows a front perspective view of the assembled liner.

In one embodiment, the present disclosure provides an insulating container liner comprising a first sectioned insulating panel piece comprising an insulating material and a thermoplastic shell enclosing the insulating material, wherein the first sectioned insulating panel piece forms the bottom, a side and top of the insulating container liner; a second sectioned insulating panel piece comprising an insulating material, and a thermoplastic shell enclosing the insulating material, wherein the second sectioned insulating panel piece forms the remaining three sides of the insulating container liner; and a flexible outer bag housing the first and second sectioned insulating panel pieces wherein the bag is attached to the first and second sectioned insulating panel pieces. In assembled form, the interior orientation of the insulated panels is clearly visible. In another embodiment, the present disclosure provides a process for producing an insulating container liner comprising: (a) preparing a first sectioned insulating panel piece comprising three sections of an insulating material having an elasticity memory by inserting each section within a thermoplastic shell, and heat-sealing the shell to encase the insulating material; (b) preparing a second sectioned insulating panel piece comprising three sections of an insulating material having an elasticity memory by inserting each section within a thermoplastic shell, and heat-sealing the shell to encase the insulating material; (c) positioning the first sectioned insulating panel piece and the second sectioned insulating panel piece in a flexible outer bag to form the shape of a container while all adjacent edges of the first and second sectioned panels are abutted in order to maintain contact of the abutted panels when the article is to be used; and (d) heat sealing the first and second sectioned insulating panel pieces to the outer bag.

In still another embodiment, the present disclosure provides an insulating container liner comprising sectioned insulating panel pieces comprising an insulating material and a thermoplastic shell enclosing the insulating material, wherein the sectioned insulating panel pieces form the bottom, sides and top of the insulating container liner.

DETAILED DESCRIPTION OF THE INVENTION

In one embodiment, the present disclosure provides an insulating container liner comprising a first sectioned insulating panel piece comprising an insulating material and a thermoplastic shell enclosing the insulating material, wherein the first sectioned insulating paneling piece forms the bottom, side and top of the insulating container liner; a second sectioned insulating panel piece comprising an insulating material, and a thermoplastic shell enclosing the insulating material, wherein the second sectioned paneling piece forms three remaining sides of the insulating container liner; and a flexible outer bag housing the first and second sectioned insulating panel pieces wherein the bag is attached to the first and second sectioned insulating panel pieces.

The first and second sectioned insulating panels of the insulating container liner preferably comprise three panels, however, any multitude of panels can be utilized that will line the interior of six-sided container. Preferably, the insulating material for the first and second sectioned insulating panels has an elasticity memory. Preferably, the insulating container liner is formed in the shape of the container. Preferably, the insulating container liner is collapsible and compressible, and is vented to allow the escape of gases when compressed. Preferably, the insulating material is selected from open cell polyurethane foam or polyester fiber. Preferably, the thermoplastic shell of the first and second sectioned insulating panels is selected from a heat sealable plastic film having a first side and a second side. Preferably, either the first side or second side of the heat sealable plastic film is heat sealable. More preferably, both the first side and second side are heat sealable. Preferably, the outer bag of the insulating container liner is selected from metalized polyester having a first side and a second side coated with polyethylene, or is a heat-sealable plastic film. Preferably, the metalized polyester is coated with polyethylene on the first side. Preferably, the insulating container liner is in the form of a cube or cuboid. Preferably, the outer bag of the insulating container liner is heat sealable. Preferably, the outer bag is gusseted or presented with an expansion feature that minimizes the excess film in expanded form. Preferably, all thermoplastic film materials used for the flexible outer bag and wrapping of first and second insulating panels are designed to withstand high shear and compression force.

In another embodiment, the present disclosure provides a process for producing an insulating container liner comprising: (a) preparing a first sectioned insulating panel piece comprising three sections of an insulating material having an elasticity memory by inserting each section within a thermoplastic shell, and heat-sealing the shell; (b) preparing a second sectioned insulating panel piece comprising three sections of an insulating material having an elasticity memory by inserting each section within a thermoplastic shell, and heat-sealing the shell; (c) positioning the first sectioned insulating panel piece and the second sectioned panel piece in a flexible outer bag to form the shape of a container; and (d) heat sealing the first and second sectioned insulating panel pieces to the outer bag. Preferably, the insulating material of the first and second sectioned insulating panel pieces have an elasticity memory.

In still another embodiment, the present disclosure provides an insulating container liner comprising sectioned insulating panel pieces comprising an insulating material and a thermoplastic shell enclosing the insulating material, wherein the sectioned insulating panel pieces form the bottom, sides and top of the insulating container liner.

In still another embodiment, the present disclosure provides an insulating container liner comprising sectioned insulating panel pieces comprising an insulating material and a thermoplastic shell enclosing the insulating material, wherein the sectioned insulating panel pieces form the bottom, sides and top of the insulating container liner. The insulating container can further include a flexible outer bag housing that is attached to the sectioned insulating panel pieces, e.g., by heat sealing. Preferably, the insulating container liner has an elastic memory and is collapsible and compressible. Preferably, the sectioned insulating panel pieces of the insulating container liner are attached to the thermoplastic shell, e.g., by heat sealing, thereby creating a three dimensional container. Preferably, the three dimensional container can be temporarily collapsed and compressed to less than half its original volume, and can return to substantially its original volume.

The article herein described is a pre-assembled padded insulated liner that is collapsible, can be compressed for storage and transport and provides visibility to assure proper assembly inside a shipping container.

Figure 2:
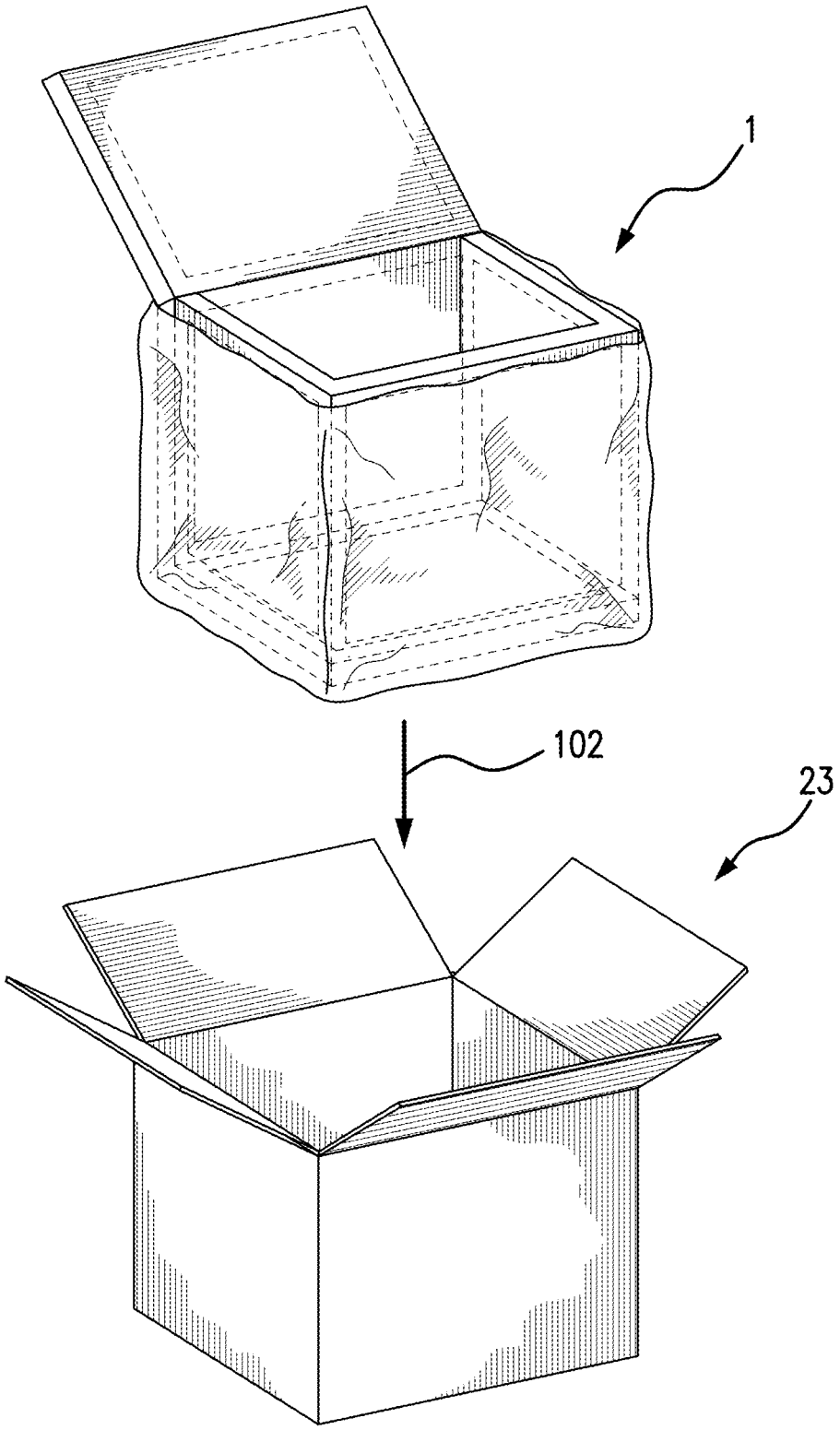
FIG. 2 shows a perspective view of the assembled liner being inserted into a container.

Such an article is shown in FIG. 1, which requires a shell type exterior bag such that when fully opened, the fully opened dimensions of such a bag closely resemble the dimensions of the article in assembled form. The dimensions of such a bag will be tailored to roughly match the interior dimensions of the shipping container that is to be lined and thus insulated, as shown in FIG. 2. Such a bag, shown in FIG. 3, must be flexible, collapsible, and preferably heat sealable with an interior that is of lower melt temp than the exterior. The bag preferably presents a square bottom in open form and is preferably a gusseted bag. The bag serves to position said panels attached to it into a five-sided, open top container, in addition to being indirectly attached to a sixth side that is the top of the container.

Figure 3:
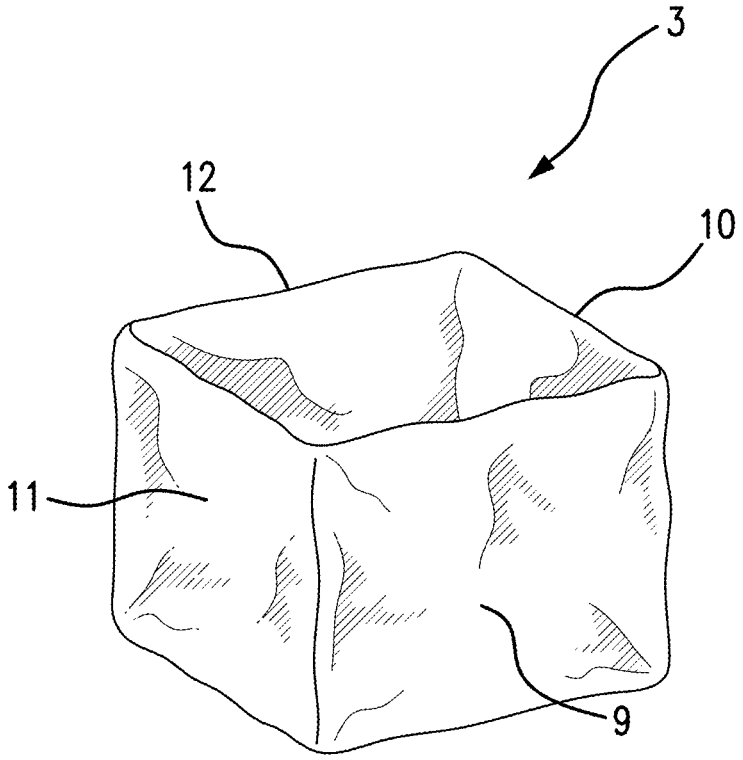
FIG. 3 shows a perspective view of the flexible outer bag.
Figure 4:
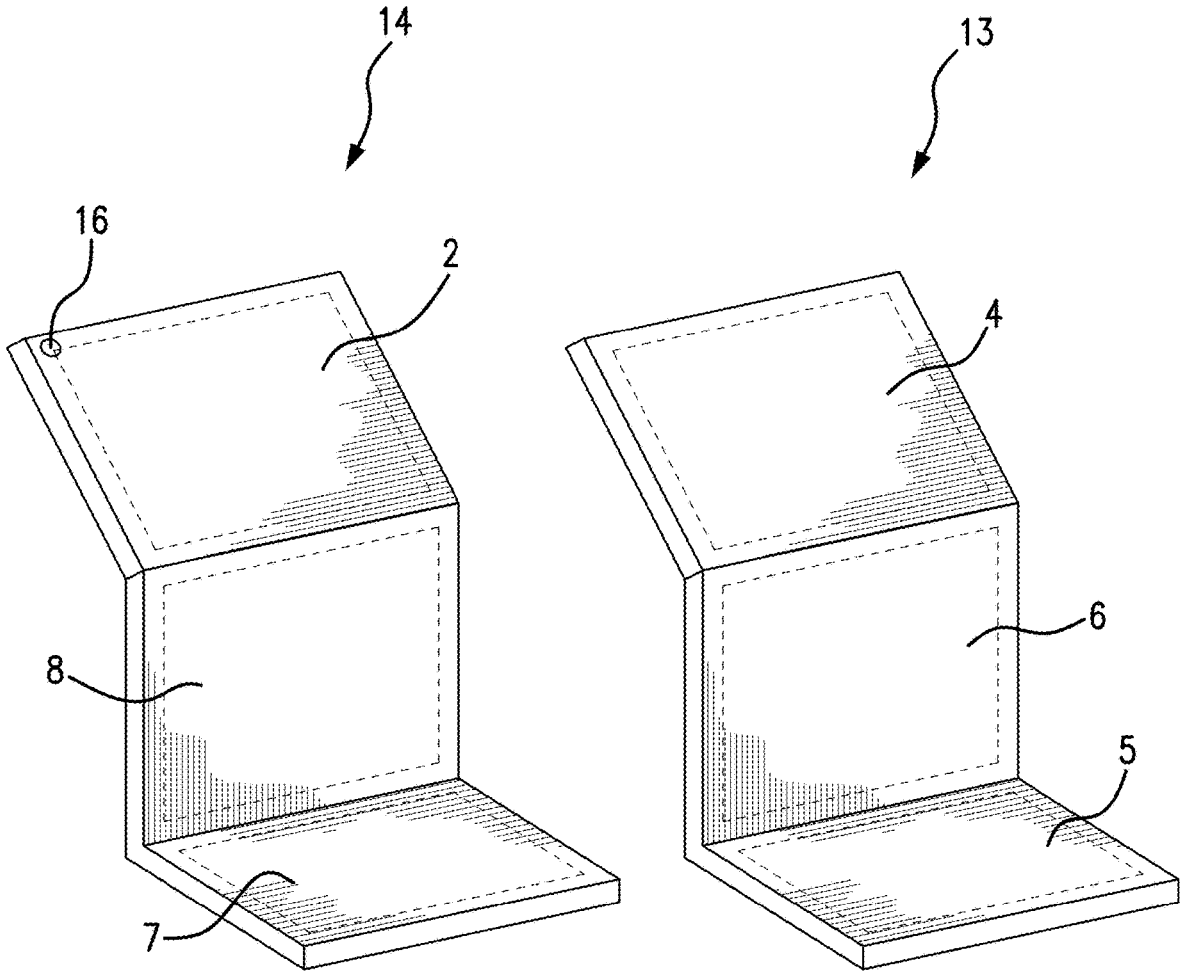
FIG. 4 shows a perspective view of the first and second sectioned insulating panel pieces.

The interior of the bag in FIG. 3 is preferably affixed to flexible insulating padding shown in FIG. 4 manufactured in the dimensions to enable the preferably complete lining and coverage of the desired shipping container, as shown in FIG. 2. Preferably, such padding is attached to and/or is preferably first encased in a plastic type matching that of the interior of the said bag in FIG. 1 to facilitate heat sealing.

Figure 5:
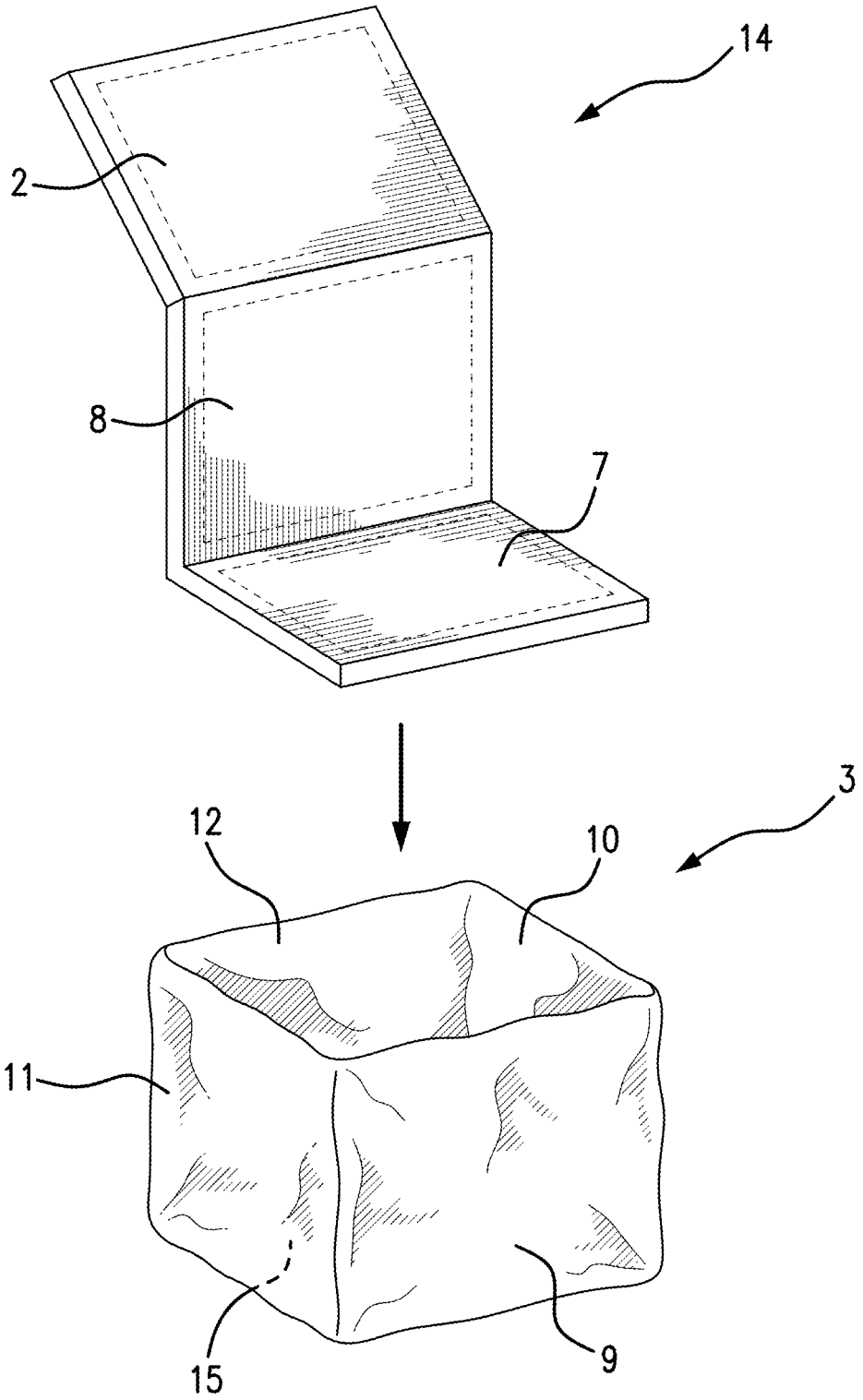
FIG. 5 shows a perspective view of the first sectioned insulating panel piece being inserted into flexible outer bag 3.
Figure 6:
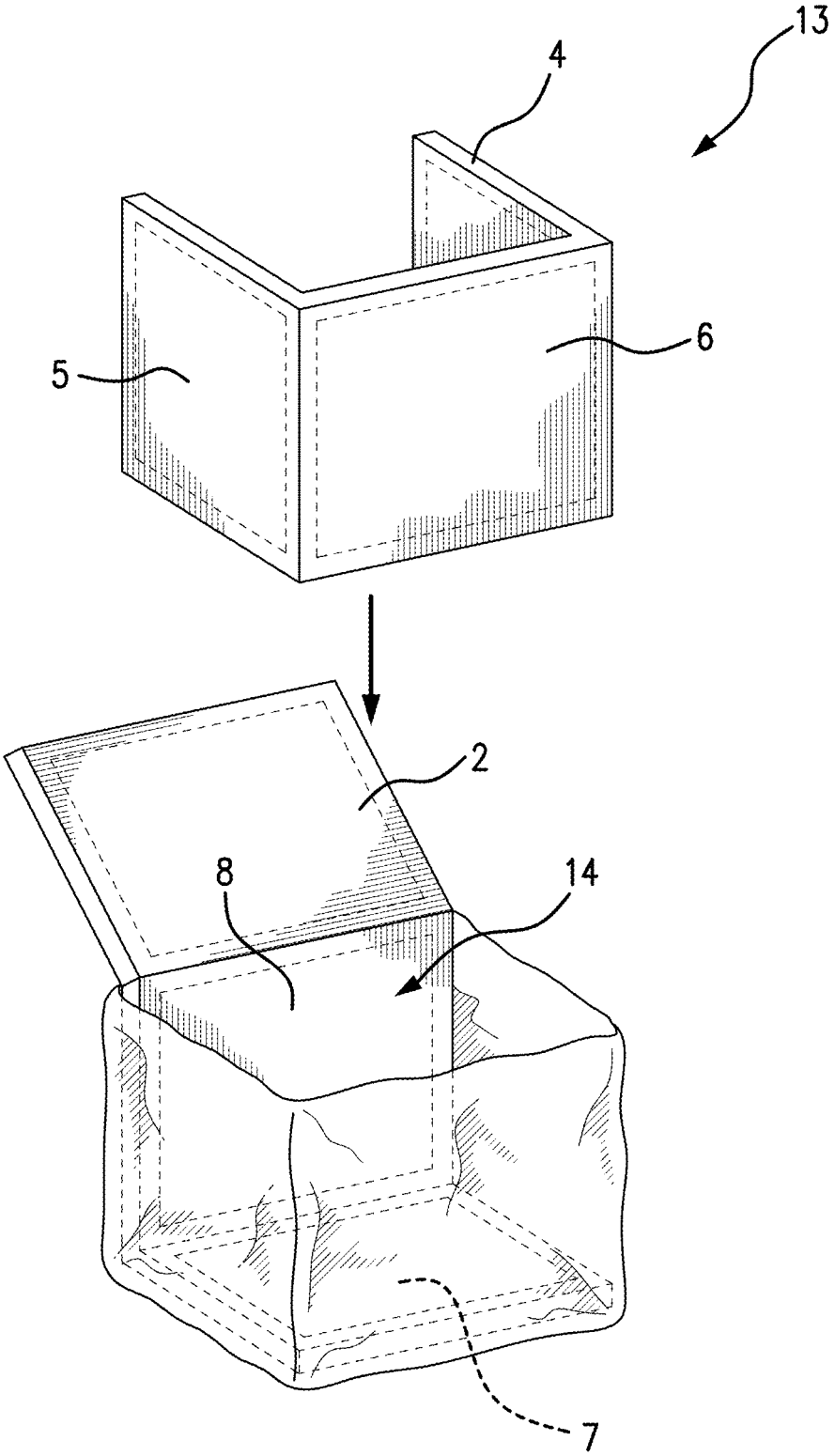
FIG. 6 shows a perspective view of the second sectioned insulating panel piece being inserted into outer bag 3.

The insulating padding is produced from a flexible insulating material with elastic memory, where for the purposes of this disclosure, "elastic memory" means that if it is compressed and stored in compressed form, it can later return to substantially its original form when the device maintaining the compression is removed or otherwise disabled. Preferably, the insulating material is flexible polyurethane foam, non-woven recycled textile based insulated padding or polyester fiber The liner can be manufactured using steps where the bag of FIG. 3 is opened and then lined with insulating panels, as shown in FIG. 5. First, one of the three pad panels is inserted in the bag lining the bottom and one side. The remaining pad serves as the top of the completely assembled liner. In FIG. 6, the second three pad panel is utilized to line the remaining sides of the bag. The bag with the combined liners inside, now finally assembled, preferably presents a cube shape with a top panel that is unattached and can be swung open or closed, such an article is then put into a heat-sealing process where the liners are heat sealed to the outer bag.

The heat-sealing process is preferably performed in a process where an assembled liner bag is introduced to an assembly line type process that mechanically advances the article forward while applying heat to the outer bag that is in contact with the heat sealable wrapping of the insulating padding. As the article is advanced forward using a device preferably with motorized belts, heat is applied, preferably using forced hot air, where they contact the outer bag. Heat seals can also be applied using contact heat from heating elements that are moving in the machine direction, stationary or from heated air. The outer bag may be designed to extend above the top panel on at least one side to allow it to fold over the lid of the article. In addition, the outer bag can be designed to serve as a heat shield to the exposed edges of the wrapped insulated panels during the heat sealing process where the outer bag is sealed to the panels.

Since the article presents five sides that preferably require heat seals that are preferably in a substantially parallel pattern relative to the edges of the box, the assembled six sided box shaped article can receive the necessary heat seals in a machine driven fashion on two side panels and a bottom panel, in the direction of travel only; a subsequent step of heat sealing the perpendicular faces of the article and perpendicular unsealed edges of the bottom is performed. Such a step is preferably performed by subsequently introducing the article into a preferably belt driven heat seal device that is oriented at a 90-degree angle from the original device, and such a device performs the heat seals to the remaining unsealed edges that are at a 90-degree angle from the already applied heat seals. Alternatively, the perpendicular seals can be applied by rotating the article and placing it inside the device in the same direction by moving them to the entry point of the apparatus or rotating the articles and re-entering them into the device by utilizing the machine in reverse direction.

A similar process can be performed where the article is moved vertically, and side panels are heat sealed in a vertical fashion, with the remaining bottom panel heat sealed in another manner. Alternatively, all five or as few as one panel are heat sealed individually.

A minimum number of heat seals or connections of the liners to the outer bag is necessary in any location or configuration to enable the compressed article to return to a configuration that does not require reconfiguration of the panels after decompression. Although minor lifting of unsealed panels may be necessary, the proper location of which to install will be easily identifiable.

The article in FIG. 1, when complete, is a six-sided panel container with a flat bottom, four upright sides and a top that can swing from a position closing the container as it acts as a top, or lifted and swung down as it is hinged at the top of one of the upright side panels as in FIG. 1. The article will appear as an upright cube and can rest on a flat surface. The article, now in its expanded form can be inserted into the proper size shipping carton as in FIG. 2.

Figure 8:
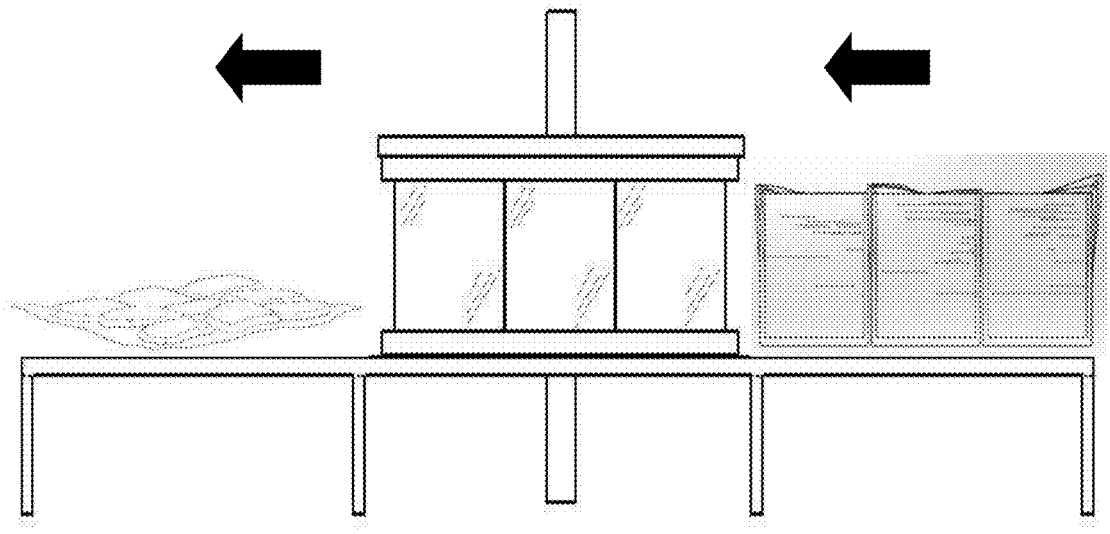
FIG. 8 shows a lot container compression device.

In order to decrease the needed storage volume and the cost of transport, lot or single quantities of such an article can be introduced to a wrapping and compression process, as in FIG. 8, that first applies mechanical pressure to compress the article to a reduced volume compared to its original size. By encasing the articles in preferably vacuum film and applying a complete hermetic seal, the compressed form as in FIG. 8 is maintained until such time that the article is to be used. At such time, the user removes the vacuum seal film and removes the compressed articles. Here, the memory of the compressed padding acts to expand, unfold and lift the padded walls along with the attached encasing film, while air enters the vent holes placed on the thermoplastic films. The outer bag type shell that was sealed to the exterior of the compressed panels now serves to hold the panels in the proper positions relative to the adjacent panels; and depending on their condition after compression, expand and unfold once again into the standing upright article in FIG. 1. This action requires no assembly in that the reforming and expansion is due to the memory of the padded foam.

The Panels

The insulating panels as shown in FIG. 4. are preferably made of open cell polyurethane foam panels that are cut to size. Such a material exhibits excellent insulation value in addition to offering elasticity that provides 'memory' properties that act to return the panel to its original form or substantially close to its original form whether deformed for a short or prolonged period. An alternative material is polyester fiber panels, and such a material exhibits similar properties while it is made of a chemically different material; additionally it is made of fibers, unlike polyurethane foam. Another alternative is non-woven recycled textile based insulated padding, preferably with memory properties.

Any material that provides cushioning and insulation can be formed into panels or walls that can line a carton and provides elastic memory if deformed can be utilized for such an application.

The two-piece configuration of the segmented panels preferably exhibits a design where each of the panels contain three panels of insulating pads that serve to line three panels of a container. Such segmentation facilitates fitting of the panels within the angled wall abutments of the carton. An alternate design for the panels is instead unsegmented entire panels of less than three separate panels.

Other variations include singular or other variations of panels that are packaged together. Any multitude of insulated pads can be utilized.

The Protected Panels

The panels shown in FIG. 4 are preferably made of open cell foam or fiber insulation that are wrapped in order to prevent contamination of the contents to be protected by the finished package. The enclosure is preferably complete, as shown in FIG. 4 where a thermoplastic film such as low-density polyethylene is used to fully enclose the panels. When a full enclosure is used, vent-holes are used to allow evacuation of gases during the compression process.

Alternatively, the panels can be covered with a protective material at inner, outer or both surfaces, leaving the edges exposed. Such a method may make vent holes unnecessary. The enclosing material is preferably made of a thermoplastic material that facilitates the heat sealing or otherwise attachment of such material to the outer bag as shown in FIG. 3. Other attachment methods include but are not limited to the use of adhesives or other mechanical attachment that can be used to attach the panels in FIG. 4 to each other facilitating the assembly and a box shaped configuration. Since the insulating material is preferably a flexible material with 'memory' of original form, the articles can be compressed and uncompressed while returning to its original general configuration.

Any flexible material can be utilized and sealed as necessary to enclose the insulated panels while allowing venting; wherein seals can also be achieved using adhesives or sewing.

The Bag Containing the Assembled Panels

The outer bag as shown in FIG. 3 provides a shell effect and helpful connectivity that maintains the positioning of the panels shown in FIG. 4 connected to it when assembled, and during decompression from a compressed state. Such a bag preferably exhibits, when expanded from a flat form to a three-dimensional form, four sides a bottom and an open top. The bag can be made of single or multiple sheets of material. A preferable form of the bag is a bottom gusset bag that can be expanded, exhibiting a square or rectangular shaped bottom connected to generally planar walls with little excess material.

Alternatively, the bag can be a flat bag with no gussets that provides a flat bottom when opened. This method of providing an outer shell can still be effective if heat sealing is used to provide connectivity of the panels as shown in FIG. 4.

The bag method is only one method of providing an external shell for the panels. Other devices, such as strips of plastic or other flexible material that provide connectivity to the panels yet remain affixed during high compression force and during compressed storage for short or extended periods of time can be used. Another alternative is sealing or otherwise attaching the encased panels to one another.

The bag method provides an additional advantage in providing a leak resistant article, and this can be beneficial when the assembled insulated container is utilized to package liquids that can leak or items that gather condensation. This advantage is optimal when the outer bag is made of thermoplastics that are preferably hermetically sealed at bottom.

Such a bag is preferably manufactured using a metalized polyester with a heat sealable polyethylene on the interior, this is preferable when used to contain insulated panels themselves wrapped in polyethylene film. The high heat resistance of the polyester material is ideal for a heat sealing application when sealing the opposite side thermoplastic to the thermoplastic encased padding when the heat is applied to the metalized polyester side. Alternatively, the bag can be manufactured from an entirely polyethylene film.

Any flexible material can be utilized and sealed as necessary to hold the insulated panels in position while allowing venting; wherein seals on the outer bag can also be achieved using adhesives or sewing.

The Compression Method

After assembly and insertion into outer bag, single or multiple quantities of assembled insulated containers can be included in a batch that is placed in a wrapping and compression process.

A preferred form of such a process includes a first wrapping step where the batch of articles to be compressed are placed on a conveyor and advanced into a web of wrapping material, preferably thermoplastic vacuum compression material, wherein the material envelopes the top and bottom of the batch. Thereafter, the partially wrapped batch is moved into a compression and additional sealing process. Here a compressing device forces air out of the batch of articles; the air held inside the panels of foam is evacuated through vent holes, e.g., as shown in FIG. 4. While in this compressed form, the compressed batch is further sealed to completely encase the compressed articles in compressed form. A preferable seal method for the preferred thermoplastic vacuum seal material is heat sealing.

An alternative compression method is possible when the same batch of articles is placed onto a surface, compressed, and while in compressed form placed into a duct-like device with an interior dimension that is close to the compressed dimensions of the batch. After placement within the duct-like device, a holding device such as thermoplastic bag is placed onto the opposite end of the duct like holding device. Thereafter, the compressed batch is advanced through the duct-like device in a motion that both places the compressed batch into the bag and removes the bag from the duct-like device. Panels are ideally arranged in a stable column format, so when compressed they don't fall apart. Alternatively, the primary compression is performed in a cavity that prevents collapsing of the column.

Alternatively, articles can be compressed and held in the compressed position using mechanical means such as strapping, twine or wiring. Compressed articles can also be placed inside a bag like device that helps maintain their compressed condition.

Referring now to FIG. 1, shown is a frontal perspective view of the assembled liner 1 which has been inserted into flexible outer bag 3. Panels 4, 5, are the end panels in a second three-piece panel inserted into the outer bag 3. Panel 6 is the middle panel in the second three-piece panel. Panels 2 and 7 are the end panels in a first three-piece panel inserted into the outer bag 3. Panel 2 also serves as the lid on the container formed by the liner. Panel 8 is the middle panel in the first three-piece panel inserted into the outer bag 3. Panels 5 and 6 are attached to outer bag 3 along lines 24, e.g., by heat sealing.

Referring now to FIG. 2, shown is a perspective view of assembled liner 1 being inserted in process 102 into container 23.

Referring now to FIG. 3, shown is a perspective view of the flexible outer bag 3, the front side 9 of the outer bag 3, sides 11 and 10 and back 12 of the outer bag 3.

Referring now to FIG. 4, shown is a perspective view of the first and second sectioned insulating panel pieces. First sectioned insulating panel piece 14 contains end panels 2 and 7, middle panel 8, and vent 16. Second sectioned insulating panel piece 13 contains end panels 4 and 5, and middle panel 6.

Referring now to FIG. 5, shown is a perspective view of first sectioned insulating panel piece 14 with end panels 2 and 7 and middle panel 8 being inserted into outer bag 3 covering the bottom 15 and rear side 12.

Referring now to FIG. 6, shown is a perspective of second sectioned insulating panel piece 13 with end panels 4 and 5, and middle panel 6 being inserted into outer bag 3 to form the front and sides of the liner, where the first sectioned panel piece 14 with end panels 2 and 7 and middle panel 8 have already been inserted into the outer bag 3.

Figure 7:
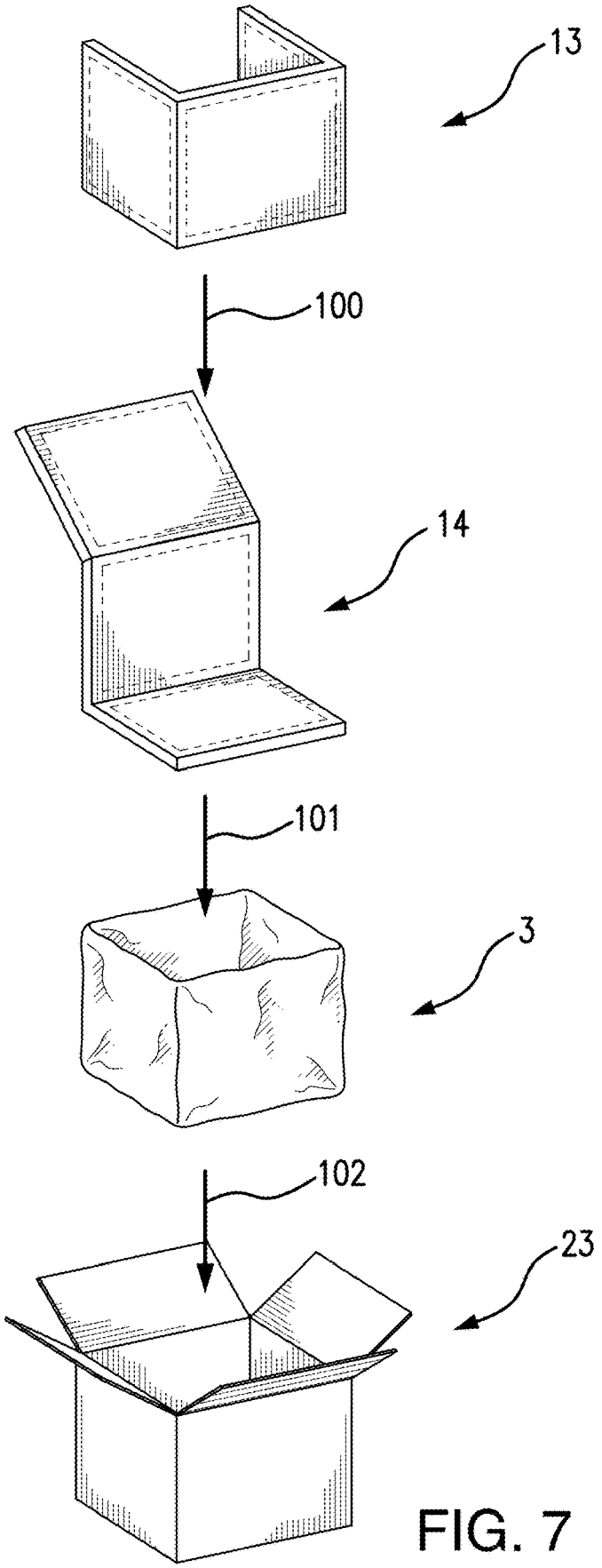
FIG. 7 shows a flow diagram of the assembly of the liner.

Referring now to FIG. 7, shown is a flow diagram of the assembly of the liner. First, sectioned insulating panel piece 14 is inserted in step 101 into the outer bag 3. Second, sectioned insulating panel piece 13 is lowered in step 100. The liner thus assembled is then lowered into container 23 in step 102.

Referring now to FIG. 8, shown is a representation of the lot compression device where lot quantities of articles can be wrapped and compressed.

Figure 9:
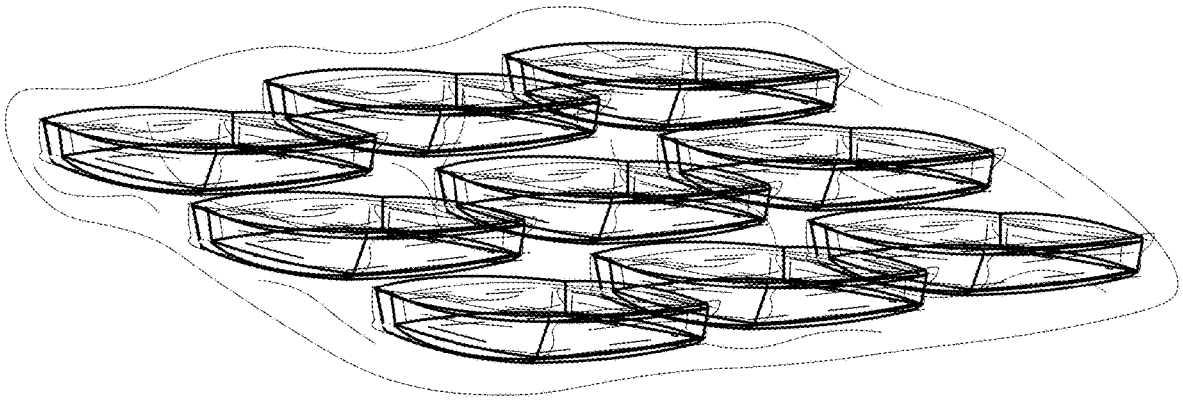
FIG. 9 shows a compressed and wrapped lot of articles in FIG. 1.

Referring now to FIG. 9, shown is a compressed and wrapped lot of the articles in FIG. 1.

Figure 10:
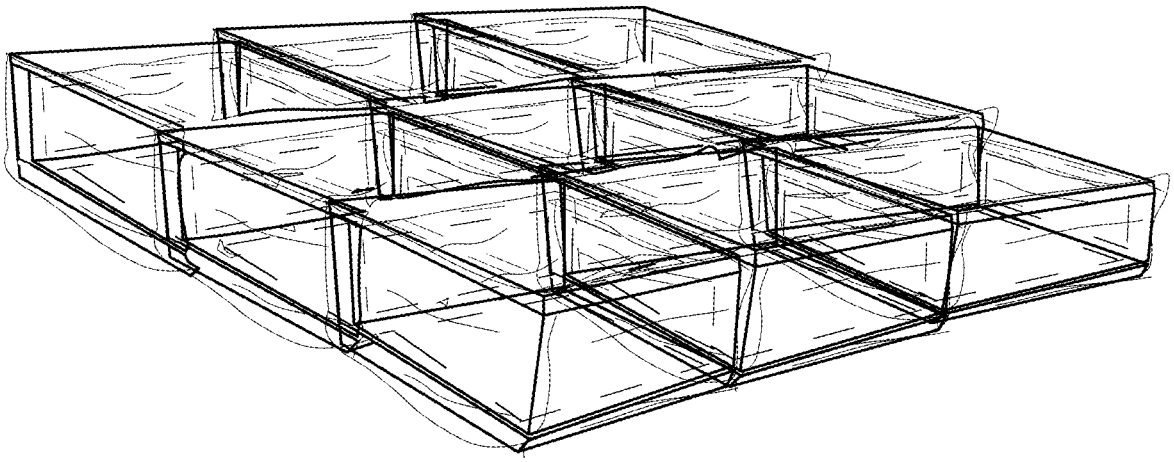
FIG. 10 shows an uncompressed lot of articles.

Referring now to FIG. 10, shown is an uncompressed lot of articles.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention not be limited by this detailed description, but by the claims and the equivalents to the claims appended hereto.

We claim:

1. An insulating container liner for a container, comprising:

a first sectioned insulating panel piece comprising an insulating material and a thermoplastic shell enclosing the insulating material, wherein the first sectioned insulating paneling piece, forms a bottom, a side and a top of the insulating container liner and the thermoplastic shell is vented;

a second sectioned insulating panel piece comprising an insulating material, and a thermoplastic shell enclosing the insulating material, wherein the second sectioned insulating paneling piece forms the remaining three sides of the insulating container liner, and the thermoplastic shell is vented; and a flexible outer bag housing the first and second sectioned insulating panel pieces wherein the bag is attached to the first and second sectioned insulating panel pieces, and is selected from metalized polyester having a first side and a second side coated with polyethylene, or a heat-sealable plastic film, and wherein the thermoplastic shells of the first and second insulating panel pieces are heat sealed to the outer bag, and the insulating material is selected from open cell polyurethane foam, non-woven recycled textile based insulated padding or polyester fiber.

2. The insulating container liner of claim 1 wherein the first sectioned insulating panel piece comprises three panels.

3. The insulating container liner of claim 1 wherein the second sectioned insulating panel piece comprises the three remaining panels.

4. The insulating container liner of claim 1 wherein the insulating material for the first sectioned insulating panel piece has an elasticity memory.

5. The insulating container liner of claim 1 wherein the insulating material for the second sectioned insulating panel piece has an elasticity memory.

6. The insulating container liner of claim 1 formed in the shape of a container.

7. The insulating container liner of claim 1 wherein the liner is collapsible.

8. The insulating container liner of claim 1 wherein the liner is compressible.

9. The insulating container liner of claim 1 wherein the thermoplastic shell is a heat sealable plastic film having a first side and a second side.

10. The insulating container liner of claim 9 wherein either the first side or second side is heat sealable.

11. The insulating container liner of claim 9 wherein both the first side and second side are heat sealable.

12. The insulating container liner of claim 1 in the form of a cube or cuboid.

13. The insulating container liner of claim 1 wherein the outer bag is gusseted.

14. The insulating container liner of claim 1 wherein single or multiple numbers of liners are compressed and stored in compressed form.

15. An insulating container liner comprising sectioned insulating panel pieces comprising an insulating material and a thermoplastic shell enclosing the insulating material, wherein the sectioned insulating panel pieces, form a bottom, sides and top of the insulating container liner and the thermoplastic shell of the sectioned insulating panel pieces are vented.

16. The insulating container liner of claim 15 further comprising a flexible outer bag housing attached to the sectioned insulating panel pieces by heat sealing.

17. The insulating container liner of claim 15 wherein the insulating material has an elastic memory.

18. The insulating container liner of claim 15 wherein the liner is collapsible and compressible.

19. The insulating container liner of claim 15 wherein the sectioned insulating panel pieces are attached to the thermoplastic shell, thereby creating a three dimensional container.

20. The insulating container liner of claim 19 wherein the three dimensional container can be temporarily collapsed and compressed to less than half its original volume and can return to substantially its original volume.

* * * * *